US006184874B1

(12) United States Patent
Smith et al.

(10) Patent No.: US 6,184,874 B1
(45) Date of Patent: Feb. 6, 2001

(54) METHOD FOR DRIVING A FLAT PANEL DISPLAY

(75) Inventors: Robert T. Smith, Tempe; Cecil W. Penn, Scottsdale, both of AZ (US)

(73) Assignee: Motorola, Inc., Schaumburg, IL (US)

( * ) Notice: Under 35 U.S.C. 154(b), the term of this patent shall be extended for 0 days.

(21) Appl. No.: 08/974,303

(22) Filed: Nov. 19, 1997

(51) Int. Cl.[7] ..... G09G 5/00

(52) U.S. Cl. ..... 345/204; 345/147; 315/169.3

(58) Field of Search ..... 345/204, 147, 345/148, 149, 150, 153, 155, 214, 211; 315/169.3, 169.4; 313/336, 309, 306, 351

(56) References Cited

U.S. PATENT DOCUMENTS 5,477,110 * 12/1995 Smith et al. ..... 315/169.3
5,929,828 * 7/1999 Beeteson et al. ..... 345/74

* cited by examiner

*Primary Examiner*—Amare Mengistu
*Assistant Examiner*—Jimmy H. Nguyen
(74) *Attorney, Agent, or Firm*—Kevin D. Wills; WIlliam E. Koch

(57) ABSTRACT

A method for driving a field emission display (10) includes the steps of dividing a digital video word (14), which has n-bits, into N digital sub-words (16, 17), each of which has n'-bits, and sequentially converting each of the digital sub-words (16, 17) into a control signal (27, 29). The control signals (27, 29) are sequentially utilized to control drive signals (28, 38, 39, 41) applied to the field emission display (10).

17 Claims, 6 Drawing Sheets

METHOD FOR DRIVING A FLAT PANEL DISPLAY

FIELD OF THE INVENTION

The present invention pertains to the area of flat panel displays and, more particularly, to methods for driving flat panel displays.

BACKGROUND OF THE INVENTION

It is known in the prior art to drive a flat panel display using a pulse width modulation (PWM) technique. The pulse width of a drive signal is modulated to control the brightness of the flat panel display. The pulse width modulation is implemented using a PWM clock. First, an n-bit video word is fed to a signal generator, which has n inputs for receiving the n bits. The signal generator generates one output control signal per video word. The output control signal controls the drive signal.

A drive signal is applied to each column of the display while an individual row is addressed for a duration equal to a line time. Typically, the number, n, of bits in the video word determines the number of cycles of the PWM clock during the display line time. Specifically, the number of cycles is equal to $2^n$. Thus, for an 8-bit video word the PWM clock cycles through 256 cycles. A typical value for the line time is on the order of tens of microseconds. Thus, use of an 8-bit video word results in a very short PWM clock cycle. The characteristic response time of certain display systems is such that the rise and fall times of the drive signals become significant, so that a very short PWM clock cycle can adversely affect display performance. While an 8-bit video word is useful for encoding a large number of brightness levels, it would be preferable to have a longer PWM clock cycle. Furthermore, the drivers typically used for processing 8-bit video word data are complex and costly.

Accordingly, there exists a need for an improved method for driving a pulse-width modulated flat panel display, which relaxes rise and fall time requirements and which utilizes simpler and less costly driver configurations.

Figure 1:
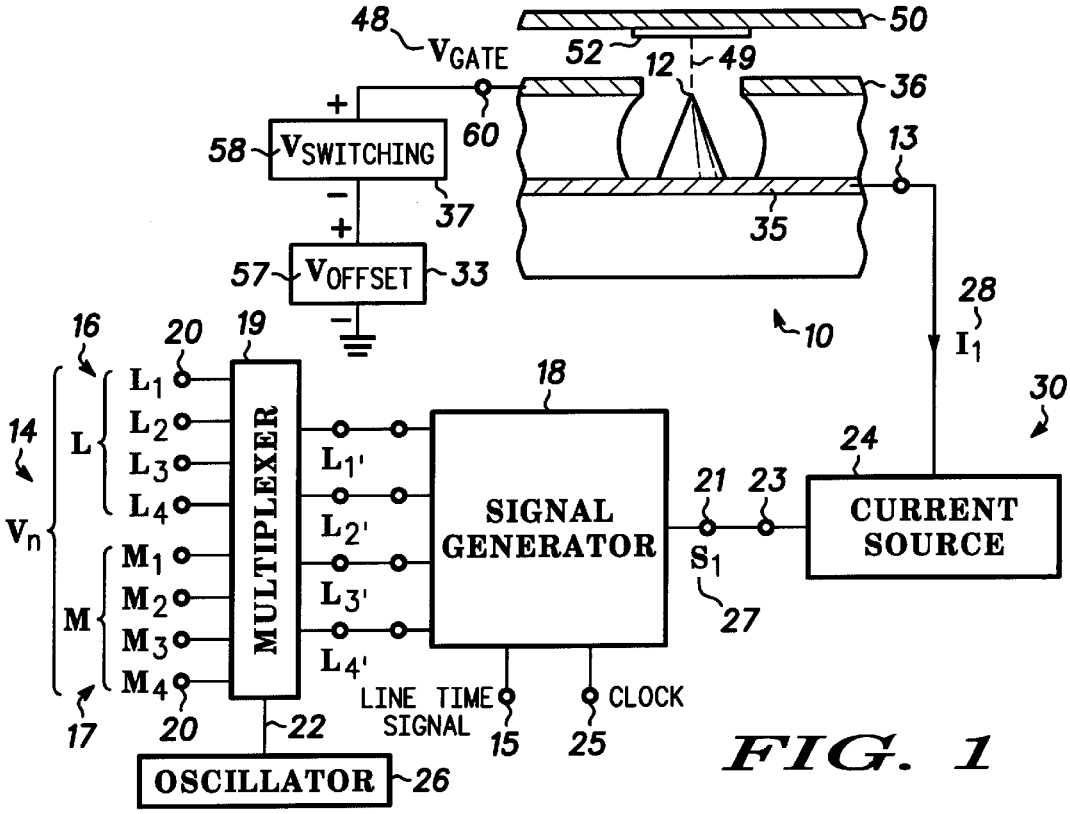
FIGS. 1 and 2 are schematic representations of a first embodiment of the method of the invention.

It will be appreciated that for simplicity and clarity of illustration, elements shown in the FIGURES have not necessarily been drawn to scale. For example, the dimensions of some of the elements are exaggerated relative to each other. Further, where considered appropriate, reference numerals have been repeated among the FIGURES to indicate corresponding elements.

DESCRIPTION

The invention is for an improved method for driving a flat panel display by pulse width modulation. In general, the method of the invention is useful for driving a flat panel display that can be driven by pulse width modulation, such as field emission displays, plasma displays, and the like. The method of the invention allows the use of simpler, less costly display drive configurations than those typically employed in the prior art. The method of the invention further relaxes signal rise and fall time requirements. The method of the invention includes the steps of dividing a digital video word into N digital sub-words and sequentially converting each of the N digital sub-words into a control signal. The digital video word has n bits, and each of the N digital sub-words has n' bits. The value of n' is given by n divided by N. In this manner, the digital video word and the corresponding control signal are temporally dithered. The drive electronics for sequentially processing digital words having n' bits are simpler than the drive electronics required for processing digital words having n bits.

FIG. 1 is a schematic representation of an embodiment of a field emission display (FED) 10 having a control circuit 30 useful for realizing the method of the invention. In the embodiment of FIG. 1, the drive signal received by FED 10 is a current signal, and control circuit 30 includes a current source 24 for generating this current signal.

FED 10 includes a plurality of electron emitters 12. Electron emitters 12 emit electrons in response to a drive signal applied to a drive signal input 13 of a cathode 35. A gate voltage 48 is applied at a signal input 60 of a gate extraction electrode 36 of FED 10. Gate voltage 48 facilitates electron emission from electron emitters 12. The electrons emitted from electron emitters 12 define an emission current 49.

FED 10 further includes an anode 50. A positive potential is applied to anode 50 for attracting emission current 49. A cathodoluminescent material or phosphor 52 is disposed on anode 50 for collecting emission current 49. Upon excitation by emission current 49, cathodoluminescent material 52 is caused to emit light.

The brightness of the emitted light depends, in part, upon the total charge received at phosphor 52. The total charge depends upon the magnitude and duration of emission current 49. By controlling the magnitude and duration of emission current 49, many gray scale or brightness levels can be realized in FED 10.

The gray scale level is encoded by a digital video word 14, which is applied to control circuit 30. The method of the invention provides a novel technique for controlling the magnitude and duration of emission current 49. The method employs pulse width modulation and temporal dithering of digital video word 14 to provide N digital sub-words.

The magnitude of emission current 49 for each drive signal depends upon the number N of sub-words into which digital video word 14 is dithered. It also depends upon the encoding characteristics of the sub-words. By temporally dithering digital video word 14, simpler drive electronics can be used, and the rise and fall time requirements of the drive signals are relaxed, as will be apparent from the description that follows.

The configuration of FIG. 1 shows control circuit 30 connected to cathode 35. However, other circuit configurations can be used to realize the method of the invention. For example, control circuit 30 can be connected to gate extraction electrode 36. Furthermore, the method of the invention is also useful for driving flat panel displays other than field emission displays.

In accordance with the method of the invention, control circuit 30 receives at a plurality of inputs 20 digital video word 14 from external circuitry (not shown). Control circuit 30 temporally dithers digital video word 14 into N digital sub-words. As shown in FIG. 1, digital video word 14 is represented by the symbol $V_n$, where n is the number of bits in digital video word 14. In the example of FIG. 1, n, the number of bits of digital video word 14, is equal to 8, and N, the number of digital sub-words, is equal to 2. However, the method of the invention is not limited to digital video words having 8-bits. For example, a 4-bit digital video word can be applied. Also, the method of the invention is not limited to the generation of two digital sub-words. For example, an 8-bit video word can be temporally dithered to provide four 2-bit sub-words.

In the example of FIG. 1, digital video word 14 has a first digital sub-word 16 and a second digital sub-word 17. First digital sub-word 16 is the least significant nibble of digital video word 14, and second digital sub-word 17 is the most significant nibble of digital video word 14. First digital sub-word 16 is represented by the symbol L and has 4 bits, numbered $L_1$, $L_2$, $L_3$, and $L_4$. Second digital sub-word 17 is represented by the symbol M and has 4 bits numbered $M_1$, $M_2$, $M_3$, and $M_4$.

In accordance with the method of the invention, control circuit 30 temporally dithers digital video word 14 and sequentially converts each of first and second digital sub-words 16, 17 into a control signal. These control signals are sequentially utilized to control a drive signal applied to drive signal input 13 of FED 10. An active time of the drive signal is responsive to the control signal. The magnitude of the drive signal can also be made responsive to the control signal, so that the magnitude of emission current 49 can be controlled by manipulating the magnitude of the drive signal. Alternatively, the magnitude of emission current 49 can be controlled by synchronized manipulation of gate voltage 48, while the magnitude of the drive signal remains constant for all sub-words.

During the operation of FED 10, the gate extraction electrodes are sequentially scanned. Each gate extraction electrode is addressed for a time period referred to as the line time, $T_L$. During the line time, an individually controlled drive signal is applied to each of a plurality of cathodes (one of which, for example, is shown in FIGS. 1, 2, 6, 7) in the manner described with reference to the FIGURES. The refresh rate or frame rate of FED 10 and the number of scanned lines determine the line time. In the examples of the FIGURES, the scanned lines are the gate extraction electrodes. However, the method of the invention is also useful for a configuration wherein the scanned lines are the cathodes. A typical frame rate is sixty Hertz (60 Hz). The corresponding line time for a FED having a monochrome VGA format is approximately 35 microseconds.

Figure 2:
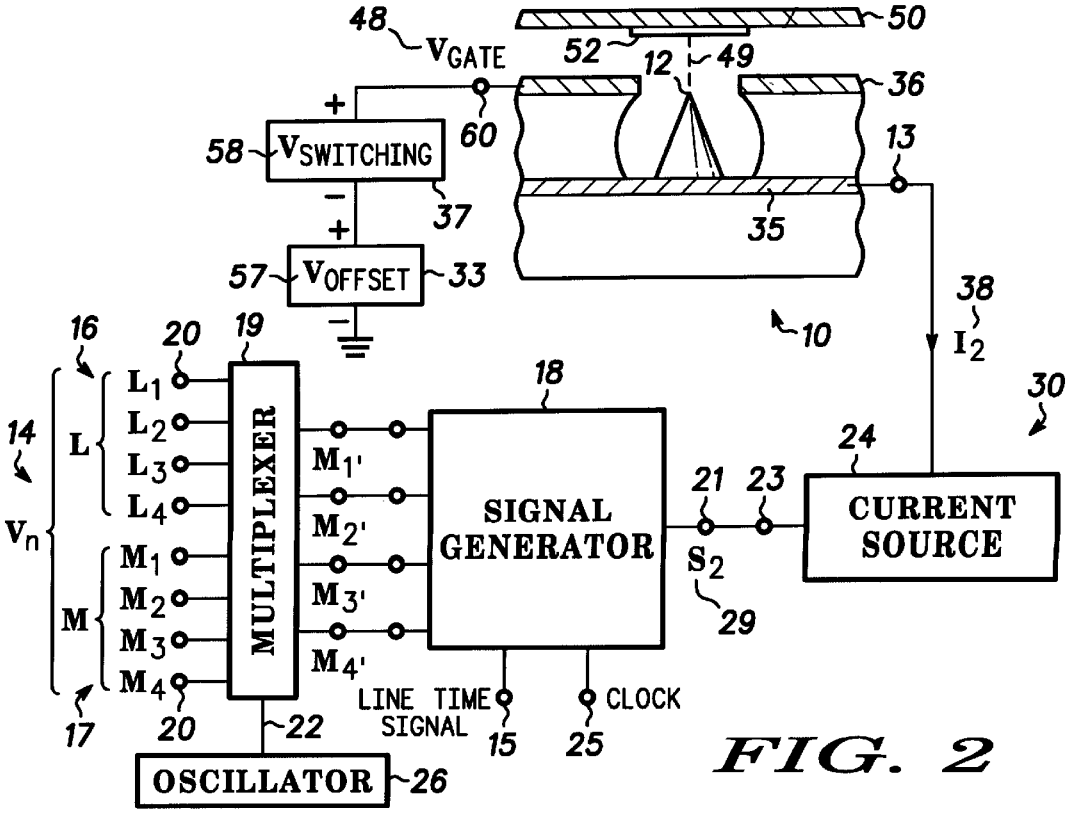

FIGS. 1 and 2 illustrate the signal configurations realized during the processing of digital video word 14 by the method of the invention. First, as illustrated in FIG. 1, first digital sub-word 16 is converted into a first control signal 27 ($S_1$). It is desired to be understood that the sub-words of the digital video word need not be introduced in any particular sequence. For example, second digital sub-word 17 can be selected first. However, as described above, the magnitude of emission current 49 differs for each sub-word. Thus, in general, the magnitude of emission current 49 is made responsive to the order of selection of the sub-words.

As illustrated in FIG. 1, control circuit 30 includes a multiplexer 19, which selects first digital sub-word where the selected first digital sub-word 16 is represented by the symbol L and has four bits numbered $L_1$,$L_2$, $L_3$, and $L_4$16. An oscillator 26 is connected to multiplexer 19 by a control line 22 and is used to control the timing of multiplexer 19. Control circuit 30 further includes a signal generator 18 that has a number of inputs corresponding to the number of bits in first digital sub-word 16. In the embodiment of FIG. 1, signal generator 18 has four inputs for receiving first digital sub-word 16. Signal generator 18 also receives a clock 25 and a line time signal 15. Clock 25 and line time signal 15 are utilized as timing signals within signal generator 18 (as described in greater detail with reference to FIG. 4). Signal generator 18 creates first control signal 27, which has an active time that is responsive to the value of first digital sub-word 16.

In the embodiment of FIG. 1, the drive signal, which is utilized to drive electron emitter 12, is a current signal. Control circuit 30 includes current source 24 for generating this current signal. An output 21 of signal generator 18 is connected to an input 23 of current source 24 for transmitting first control signal 27 to current source 24. Current source 24 is connected to drive signal input 13 of FED 10 for transmitting the drive signal to FED 10. In the configuration of FIG. 1, a first drive signal 28 ($I_1$) is generated by current source 24 in response to first control signal 27. The active time or duration of first drive signal 28 is responsive to first control signal 27. The magnitude of first drive signal 28 can also be made responsive to first control signal 27.

Subsequent to the selection and utilization of first digital sub-word 16 and as illustrated in FIG. 2, second digital sub-word 17 is selected by multiplexer 19 and converted into a second control signal 29 by signal generator 18. Second control signal 29 has an active time that is responsive to the value of second digital sub-word 17. Second control signal 29 is utilized to control a second drive signal 38 ($I_2$), which is generated by current source 24 in response to second control signal 29. The active time or duration of second drive signal 38 is responsive to second control signal 29. The magnitude of second drive signal 38 can also be made responsive to second control signal 29.

Figure 3:
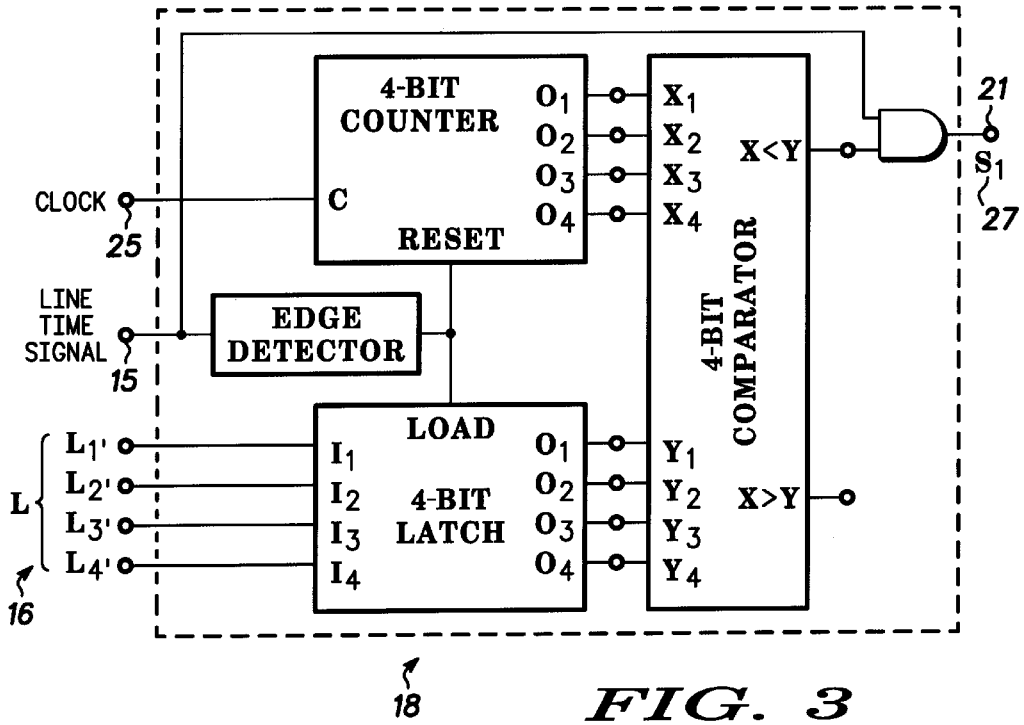
FIG. 3 is a schematic representation of a signal generator operating in accordance with the invention.

FIG. 3 is a schematic representation of an embodiment of signal generator 18 of control circuit 30. As shown in FIG. 3, signal generator 18 is implemented to receive a four-bit nibble. In general and in accordance with the invention, the line time of the display is effectively divided into N line segments, where N is equal to the number of sub-words. Each sub-word is displayed during one of the N line segments, and only one sub-word is displayed per line segment. To implement this sequence of signals, line time signal 15 is made active for a time equal to 1/N times the line time of the display, where N is the total number of sub-words. For the example of FIGS. 1 and 2, line time signal 15 is active for a time equal to __ times the line time of the display.

Line time signal 15 is presented to an edge detector that develops a short load pulse at the positive edge of line time signal 15. The short load pulse is presented to a four-bit latch where the short load pulse is utilized to load first digital sub-word 16 into the latch. A four-bit counter receives the short load pulse as a reset pulse to clear the counter to zero at the beginning of each line segment. Clock 25 is connected to a clock input of the 4-bit counter in order to increment the counter value at each time slot time starting at the beginning of time slot one. The output of the counter and the output of the latch are received by the X and Y inputs, respectively, of a four-bit comparator, which compares the value of the latch output to the value of the counter output. First control signal 27 is generated by logically "ANDing" line time signal 15 with the X<Y output of the comparator.

Figure 4:
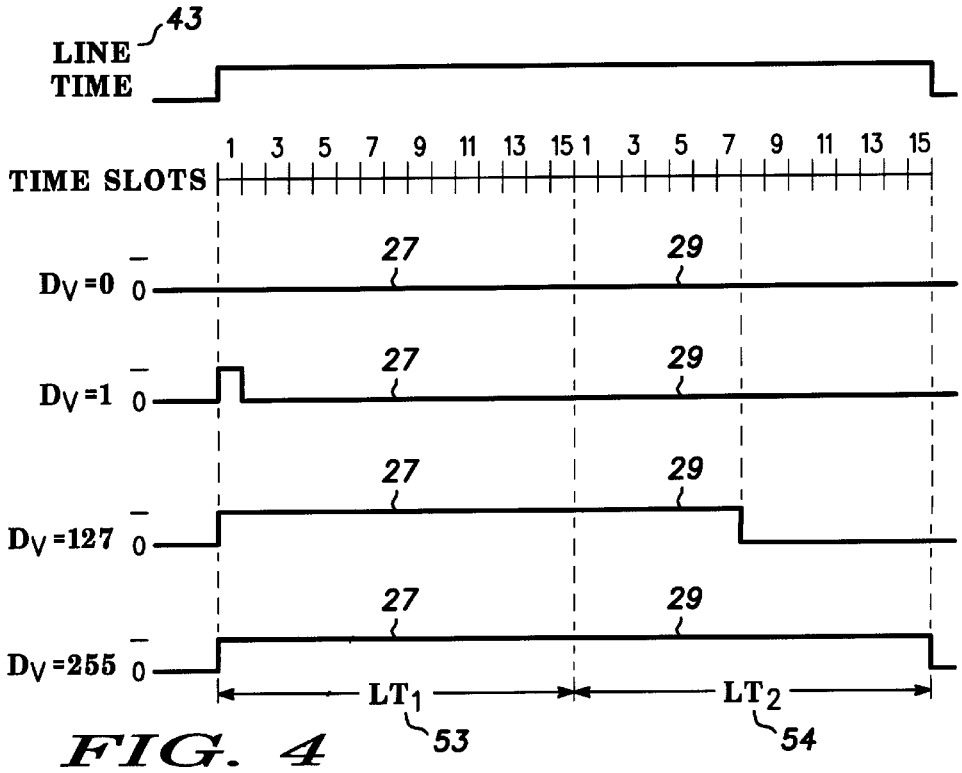
FIGS. 4 and 5 are timing diagrams in accordance with the invention.

FIG. 4 is a timing diagram useful for implementing the method of the invention. In the example of FIG. 4, line time signal 15 is made active twice during a line time 43. In this manner, signal generator 18 effectively divides line time 43 into first and second line time segments 53, 54. First line time segment 53 is labeled $L_1$, and second line time segment 54 is labeled $L_2$.

Gate extraction electrode 36 is addressed throughout line time 43. Clock 25 oscillates at a rate equal to $N*(2^{n/N}-1)$ divided by line time 43. Signal generator 18 divides line time 43 into a number of time slots equal to N times the maximum number of increments that can be encoded by the number of bits in each sub-word. For the example of FIGS. 1–3, each sub-word has four bits (n=4), and there are two sub-words (N=2). The maximum number of increments that can be encoded by the number of bits in each of first and second digital sub-words 16, 17 is $(2^{8/2}-1)$ or 15. Thus, signal generator 18 divides line time 43 into 30 time slots. In this manner, first and second digital sub-words 16, 17 can be sequentially processed during line time 43.

In contrast, a typical signal generator having 8 inputs for receiving an 8-bit video word divides the same line time into 255 time slots. Because these cycles have a much shorter period, the rise and fall times of signals need to be fast. Furthermore, a typical 8-bit driver is more complex and costly than a signal generator designed to receive digital words having fewer than 8 bits.

The number of time slots during each of first and second line time segments 53, 54 is determined by the number of bits in the sub-word displayed during the line time segment. First digital sub-word 16, which has 4 bits, is displayed during first line time segment 53. Thus, first line time segment 53 is divided into $(2^4-1)$ or 15 time slots. These increments are referred to as time slot one through time slot fifteen. Signal generator 18 activates first control signal 27 for the number of time slots encoded by first digital sub-word 16.

Second digital sub-word 17, which also has 4 bits, is displayed during second line time segment 54. Thus, second line time segment 54 is divided into $(2^4-1)$ or 15 time slots. These increments are also referred to as time slot one through time slot fifteen. Second control signal 29 is active for the number of time slots encoded by second digital sub-word 17.

Further illustrated in FIG. 4 are the configurations of first and second control signals 27, 29 ($S_1$ and $S_2$) for various decimal values, $D_v$, of digital video word 14. The first plot of FIG. 4 illustrates the conditions of first and second control signals 27, 29 when digital video word 14 has a decimal value of zero ($D_v$=0). For this condition, first digital sub-word 16 has a decimal value, $D_L$, equal to zero, and second digital sub-word 17 has a decimal value, $D_M$, equal to zero. Consequently, first and second control signals 27, 29 are inactive.

The second plot of FIG. 4 illustrates the conditions of first and second control signals 27, 29 when digital video word 14 has a decimal value of one ($D_v$=1). For this condition, first digital sub-word 16 has a decimal value, $D_L$, equal to one, and second digital sub-word 17 has a decimal value, $D_M$, equal to zero. Consequently, first control signal 27 becomes active during time slot one and is inactive for all other time slots within first line time segment 53, and second control signal 29 is inactive for all time slots of second line time segment 54.

The third plot of FIG. 4 illustrates the conditions of first and second control signals 27, 29 when digital video word 14 has a decimal value of 127. For this condition, first digital sub-word 16 has a decimal value of 15, and second digital sub-word 17 has a decimal value of 7. Consequently, first control signal 27 is active during time slots one through fifteen of first line time segment 53, and second control signal 29 is active during time slots one through seven of second line time segment 54.

The fourth plot of FIG. 4 illustrates the conditions of first and second control signals 27, 29 when digital video word 14 has a maximum decimal value of 255. For this condition, first digital sub-word 16 has a decimal value of 15, and second digital sub-word 17 has a decimal value of 15. Consequently, first control signal 27 is active during time slots one through fifteen of first line time segment 53, and second control signal 29 is active during time slots one through fifteen within second line time segment 54.

Figure 5:
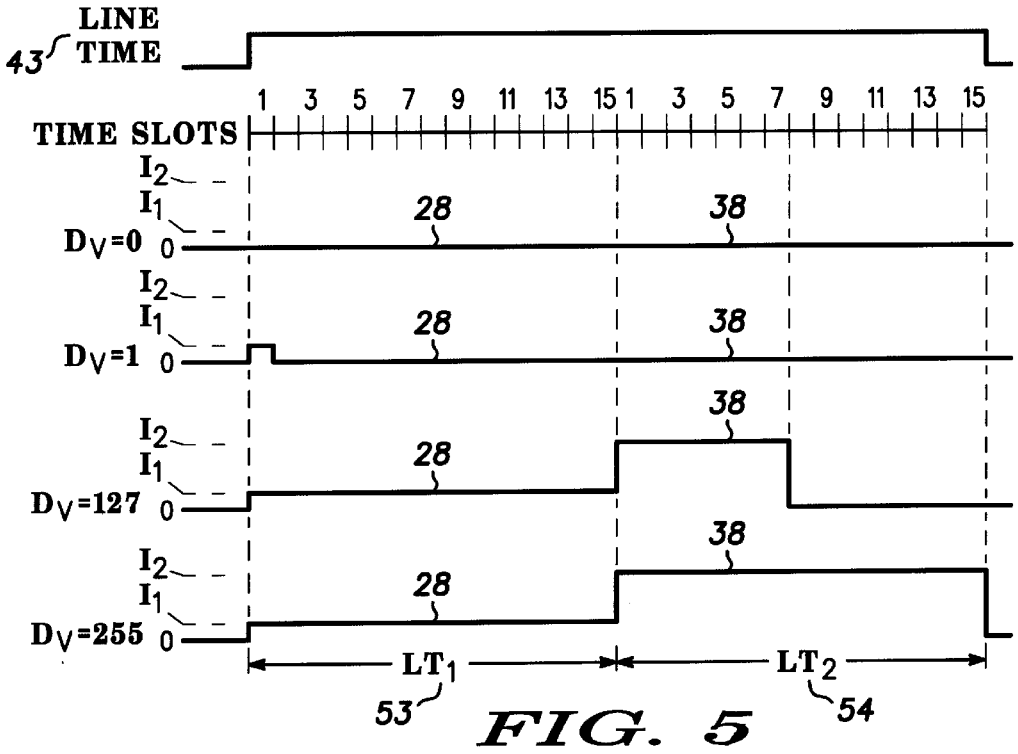

FIG. 5 is a timing diagram useful for implementing the method of the invention. The plots in FIG. 5 correspond to the plots in FIG. 4 and illustrate the conditions of first and second drive signals 28 ($I_1$), 38 ($I_2$) for the same four decimal values of digital video word 14.

Referring back to FIGS. 1 and 2, current source 24, which is used to generate first and second drive signals 28, 38, can be implemented by a variety of techniques that are well known to those skilled in the art. For example, current source 24 can be an NPN transistor with a base connected to input 23, a collector connected to drive signal input 13, and an emitter connected to a resistor, which is connected to a voltage source. The voltage source can change between two values, which are selected to provide the appropriate magnitudes of first and second drive signals 28, 38. The voltage switching is synchronized with the timing of the line time segments. For the example of FIGS. 1 and 2, the magnitude, $I_1$, of first drive signal 28 is equal to $(30/255)I_m$, and the magnitude, $I_2$, of second drive signal 38 is equal to $(480/255)I_m$, where $I_m$ is an experimentally derived value.

The value of $I_m$ is determined by developing a current versus intensity characteristic curve for the type of field emission display to be driven by control circuit 30. Techniques to develop such curves are well known to those skilled in the art. The magnitudes of the currents corresponding to the digital sub-words are derived to satisfy certain conditions. One of these conditions is that the brightness realized by the method of the invention for a configuration, in which each sub-word is active for the maximum number of time slots is equal to a reference brightness. The reference brightness is realized by driving the FED with a current equal to $I_m$ for the entire line time.

In general, the magnitudes of the current drive signals ($I_1$, $I_2$, . . . $I_N$) are derived as follows. The values of these currents satisfy the following equation:

$$I_m[T_L/(2^n-1)]D_v=I_1[(T_L/N)/(2^{n/N}-1)]D_1+I_2[(T_L/N)/(2^{n/N}-1)]D_2+\ldots I_N[(T_L/N)/(2^{n/N}-1)]D_N, \quad (1)$$

where:

n=number of bits in the digital video word fed to the FED, $T_L$=line time, $I_m$=experimentally derived current, as described above, $D_v$=decimal value of the digital video word fed to the FED, N=total number of digital sub-words into which the digital video word is divided, $D_1$=decimal value of first digital sub-word, $D_2$=decimal value of second digital sub-word, $D_N$=decimal value of Nth digital sub-word, $I_1$=current corresponding to first digital sub-word, $I_2$=current corresponding to second digital sub-word, and $I_N$=current corresponding to Nth digital sub-word.

The term on the left-hand side of Equation (1) represents the total charge required to provide a given brightness level. This brightness level is realized by driving the FED with a current drive signal having a magnitude of $I_m$ and having a duration given by $[T_L/(2^n-1)]D_v$. The summation on the right-hand side of Equation (1) represents the summation of the total charges generated by the currents that correspond to the digital sub-words. For example, the term $I_1[(T_L/N)/(2^{n/N}-1)]D_1$ represents the total charge generated by the current realized due to the first digital sub-word. This current has a magnitude of $I_1$ and a duration given by the product of the period of a time slot, $(T_L/N)/(2^{n/N}-1)$, and the number of time slots, $D_1$, over which the current is active.

For the example of FIGS. 1 and 2, n=8, N=2, and Equation (1) simplifies to:

$$[I_m/(2^8-1)]D_v=\{I_1/[2(2^4-1)]\}D_L+\{I_2/[2(2^4-1)]\}D_M. \quad (2)$$

Equation (2) must satisfy the condition in which $D_v$ equals one, $D_L$ equals one, and $D_M$ equals zero:

$$[I_m/(2^{8-1})][1]=\{I_1/[2(2^4-1)]\}\{1\}+\{I_2/[2(2^4-1)]\}\{0\}. \quad (3)$$

Equation (3) is used to express $I_1$ in terms of $I_m$:

$$I_1=(30/255)I_m. \quad (4)$$

Equation (2) must also satisfy the condition in which $D_v$ equals 255, $D_L$ equals 15, and $D_M$ equals 15. Simplifying Equation (2) for this condition and using Equation (4) to replace $I_1$, Equation (5) can be generated:

$$(I_m/255)(255)=(I_m/255)(15)+(I_2/30)(15). \quad (5)$$

Solving for $I_2$, Equation (5) yields:

$$I_2=(480/255)I_m. \quad (6)$$

Thus, the magnitudes of the current drive signals depend upon the number of sub-words into which the digital video word is divided. They also depend upon the relationship between the decimal value of the digital video word and the decimal values of the digital sub-words. A similar analysis can be used to derive the magnitude of the current drive signals for digital video words having a number of bits other than 8 and/or being dithered into a number of digital sub-words other than 2.

Referring once again to FIG. 5, the first plot illustrated shows the status of first drive signal 28 and second drive signal 38 when digital video word 14 has a decimal value of zero. Under these conditions, first and second drive signals 28, 38 are also zero.

When digital video word 14 has a decimal value of one, first control signal 27 enables current source 24 to be active during time slot one of first line time segment 53. The voltage of the variable voltage source in current source 24 during first line time segment 53 is selected to provide a current having a magnitude equal to $I_1$.

When digital video word 14 has a decimal value of one-hundred twenty-seven, first control signal 27 enables current source 24 to be active during time slots one through fifteen of first line time segment 53. The voltage of the variable voltage source in current source 24 during first line time segment 53 provides a current having a magnitude equal to $I_1$. Thereafter, second control signal 29 enables current source 24 to be active during time slots one through seven within second line time segment 54. The voltage of the variable voltage source in current source 24 during second line time segment 54 is selected to provide a current having a magnitude equal to 2.

When digital video word 14 has a decimal value of two-hundred fifty-five, first control signal 27 enables current source 24 to be active during time slots one through fifteen of first line time segment 53, and second control signal 29 enables current source 24 to be active during time slots one through fifteen of second line time segment 54. The value of the voltage of the variable voltage source of current source 24 is synchronized with the timing of first and second line time segments 53, 54 to provide a current magnitude of $I_1$ for first drive signal 28 and a current magnitude of $I_2$ for second drive signal 38.

Figure 6:
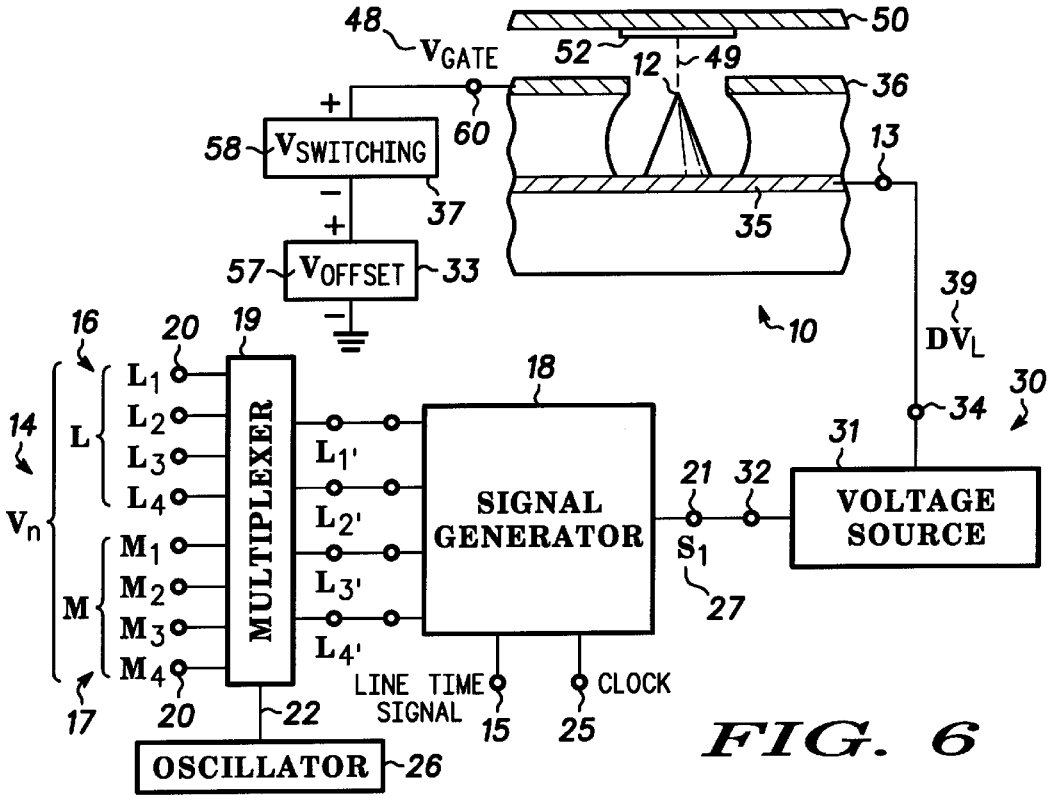
FIGS. 6 and 7 are schematic representations of another embodiment of the method of the invention.
Figure 7:
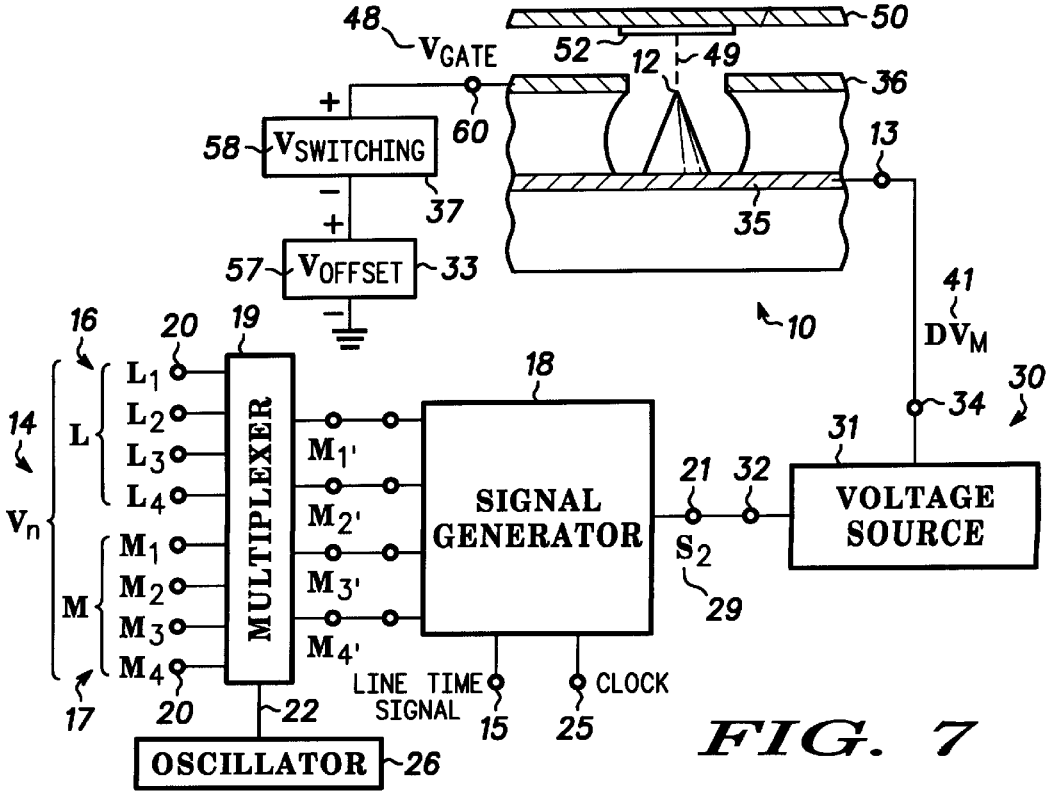

FIGS. 6 and 7 are schematic representations of another embodiment of a field emission display useful for realizing the method of the invention. In the embodiment of FIGS. 6 and 7, output 21 of signal generator 18 is connected to an input 32 of a voltage source 31, and first and second drive signals 39, 41 are voltage signals. The embodiment of FIGS. 6 and 7 utilizes various voltages to drive FED 10. An output 34 of voltage source 31 is connected to drive signal input 13.

Gate voltage 48, $V_{GATE}$, is provided by first and second voltage sources 33, 37. First voltage source 33 generates an offset voltage 57, $V_{OFFSET}$, which is applied to gate extraction electrode 36 at all times. Second voltage source 37 generates a switching voltage 58, $V_{SWITCHING}$, which is applied to gate extraction electrode 36 when gate extraction electrode 36 is being scanned. Thus, during the scanning of gate extraction electrode 36, $V_{GATE}$ is equal to $V_{ON}$, which is the sum of $V_{OFFSET}$ and $V_{SWITCHINGE}$.

Figure 8:
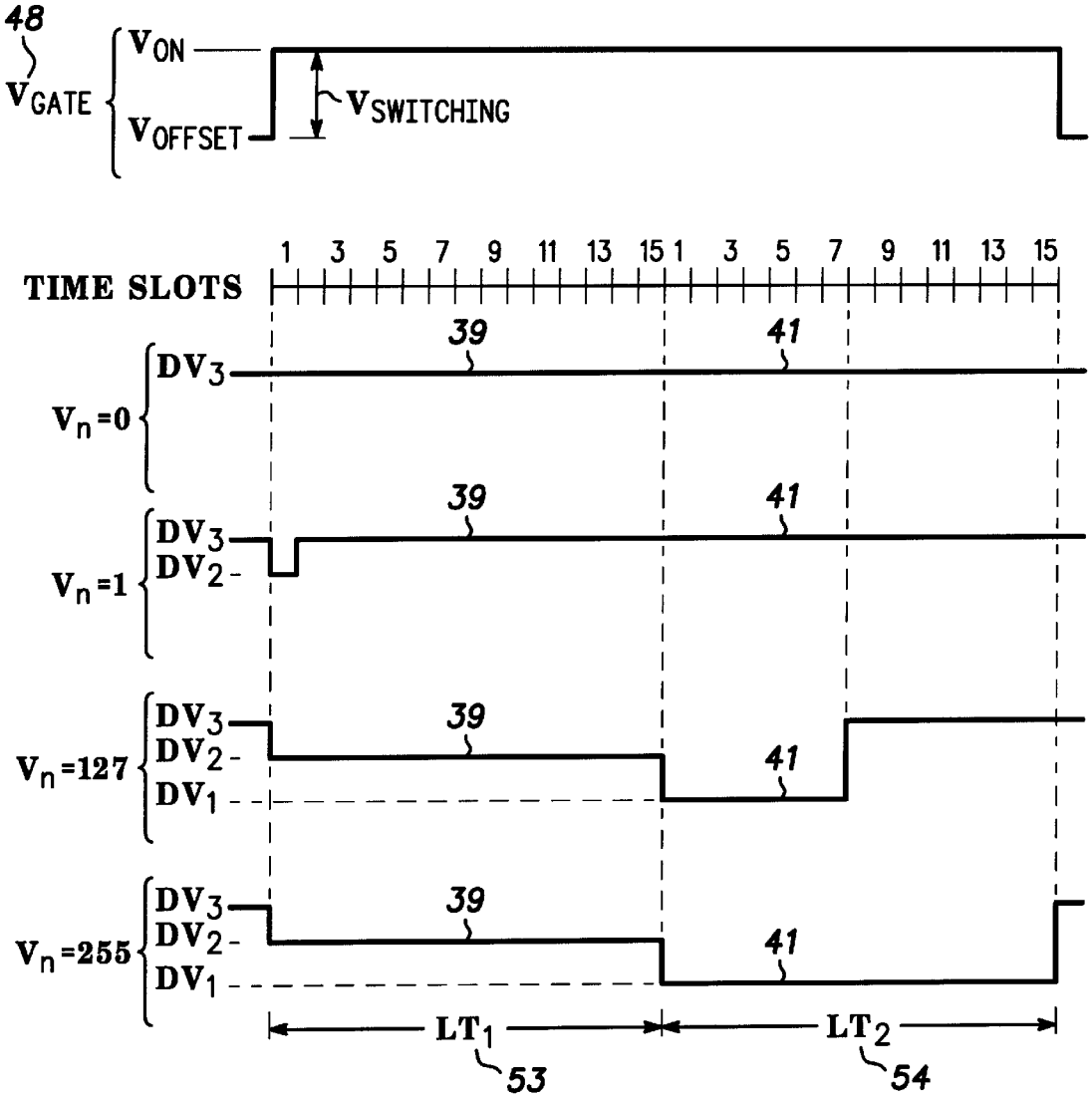
FIGS. 8 and 9 are timing diagrams in accordance with the invention.

Emission current 49 is controlled by manipulating the differential voltage between gate extraction electrode 36 and cathode 35. In one example, which is illustrated in FIG. 8, emission current 49 is controlled by manipulating the magnitudes of first and second drive signals 39, 41, while maintaining gate voltage 48 at a constant value. In the example of FIG. 8, the offset voltage and the switching voltage have constant values. Emission current 49 is controlled by varying the magnitudes of first and second drive signals 39, 41.

To implement the example of FIG. 8, voltage source 31 includes a dependent multi-state voltage source, which can be made to provide three different output voltage values: $DV_3$, $DV_2$, and $DV_1$. The value of the voltage output from voltage source 31 depends upon whether the control signal is in an active or inactive state, and on the timing of first and second line time segments 53, 54. That is, the output from voltage source 31 is synchronized with the timing of first and second line time segments 53, 54. During first line time segment 53, an active state of first control signal 27 causes an output voltage value of $DV_2$ to be selected, whereas an inactive state of first control signal 27 causes an output voltage value of $DV_3$ to be selected. During second line time segment 54, an active state of second control signal 29 causes an output voltage value of $DV_1$ to be selected, whereas an inactive state of second control signal 29 causes an output voltage value of $DV_3$ to be selected.

The different voltage values are selected to provide the emission current values that correspond to the digital sub-words. The timing diagrams of FIG. 8 are useful for and correspond to the control signal conditions described in FIG. 4. Thus, in the example of FIG. 8, $DV_3$, $DV_2$, $DV_1$, and $V_{GATE}$ are selected to realize emission currents $I_1$, $I_2$, and zero, which are described with reference to FIG. 5. The voltage values are typically determined experimentally. The field emission display is selected, and various voltages are applied until voltages are found, which provide emission currents $I_1$, $I_2$, and zero.

FIG. 8 illustrates various operational conditions of first drive signal 39 and second drive signal 41 for various values of digital video word 14. When digital video word 14 has a value of zero, voltage source 31 has an output of $DV_3$. The value of $DV_3$ is selected so that the differential voltage ($V_{ON}$–$DV_3$) results in an emission current that is equal to zero or that is negligible with respect to the generation of perceptible brightness.

When digital video word 14 has a value of one, first control signal 27 enables voltage source 31 to output a voltage equal to $DV_2$ over time slot one of first line time segment 53 and a voltage equal to $DV_3$ over time slots two through fifteen. The value of $DV_2$ is selected so that the differential voltage ($V_{ON}$–$DV_2$) results in an emission current having a magnitude of $I_1$. $DV_2$ is also selected so that the differential voltage ($V_{OFFSET}$–$DV_2$) results in zero emission current. Then, second control signal 29 enables voltage source 31 to output a voltage equal to $DV_3$ over time slots one through fifteen of second line time segment 54.

When digital video word 14 has a value of one hundred twenty-seven, first control signal 27 enables voltage source 31 to output a voltage equal to $DV_2$ over time slots one through fifteen of first line time segment 53. Thereafter, second control signal 29 enables voltage source 31 to output a voltage equal to $DV_1$ over time slots one through seven of second line time segment 54 and a voltage equal to $DV_3$ over time slots eight through fifteen. The value of $DV_1$ is selected so that the differential voltage ($V_{ON}$–$DV_1$) results in an emission current of $I_2$. $DV_1$ is also selected so that the differential voltage ($V_{OFFSET}$–$DV_1$) results in zero emission current.

Voltage source 31 can be implemented by many different circuit techniques that are well known in the art. For example, voltage source 31 can be an analog-to-digital converter that has resistor values selected to provide the desired voltage outputs. The order and timing of the selection of the resistances can be synchronized with the order and timing of the selection of the digital sub-words.

Figure 9:
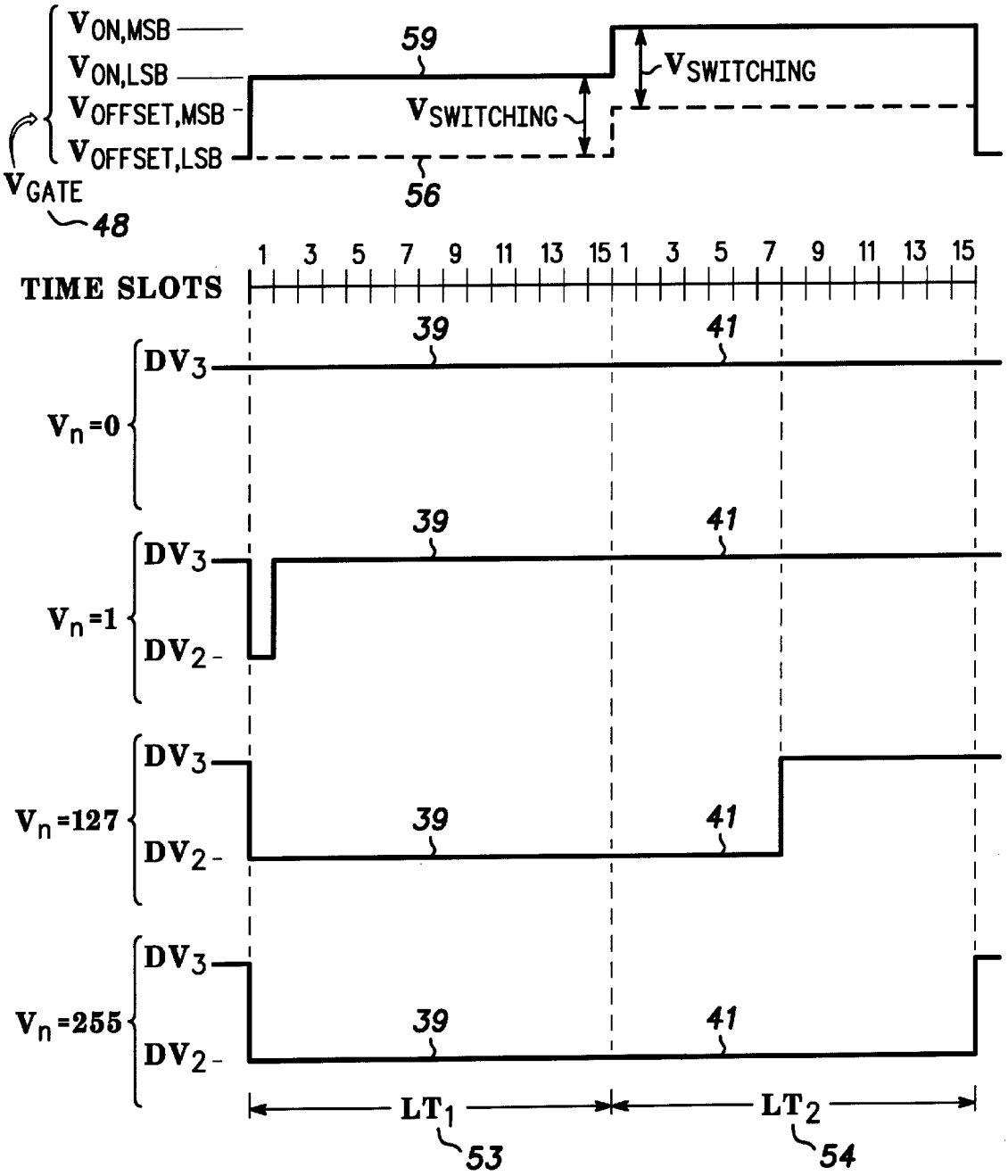

In another embodiment, which is illustrated in FIG. 9, emission current 49 is controlled by manipulating the magnitude of gate voltage 48. FIG. 9 includes the preferred timing diagrams useful for implementing the method of the invention. For the embodiment of FIG. 9, voltage source 31 has only two output voltage values: an inactive value $DV_3$ and an active value $DV_2$. The active and inactive outputs of voltage source 31 during second line time segment 54 are equal to the active and inactive outputs of voltage source 31 during first line time segment 53. This can simplify the implementation of voltage source 31. Furthermore, in the embodiment of FIG. 9, emission current 49 is controlled by manipulating a signal other than the drive signals applied to cathode 35. This capability is enabled by the temporal dithering of the digital sub-words according to the method of the invention.

FIG. 9 illustrates various operational conditions of first drive signal 39, second drive signal 41, and gate voltage 48 for various values of digital video word 14. When gate extraction electrode 36 is not being scanned, gate voltage 48 has the values indicated by a dashed line 56 in FIG. 9. During first line time segment 53, gate voltage 48 is equal to $V_{OFFSET,LSB}$, which is the value of offset voltage 57 during first line time segment 53. During second line time segment 54, gate voltage 48 is equal to $V_{OFFSET,MSB}$, which is the value of offset voltage 57 during second line time segment 54.

When gate extraction electrode 36 is being scanned or addressed, gate voltage 48 has the values indicated by a solid line 59 in FIG. 9. During first line time segment 53, gate voltage 48 is equal to $V_{ON,LSB}$, which is equal to the sum of $V_{OFFSET,LSB}$ and $V_{SWITCHING}$. During second line time segment 54, gate voltage 48 is equal to $V_{ON,MSB}$, which is equal to the sum of $V_{OFFSET,MSB}$ and $V_{SWITCHING}$.

The voltages of FIG. 9 are selected to satisfy the following conditions. The differential voltages ($V_{OFFSET,LSB}$–$DV_3$), ($V_{OFFSET,LSB}$–$DV_2$), ($V_{OFFSET,MSB}$–$DV_3$), ($V_{OFFSET,MSB}$–$DV_2$) ($V_{ON,LSB}$–$DV_3$), and ($V_{ON,MSB}$–$DV_3$) result in an emission current that is equal to zero or that is negligible with respect to producing perceptible brightness. The differential voltage ($V_{ON,LSB}$–$DV_2$) results in emission current 49 being is equal to $I_1$, and differential voltage ($V_{ON,MSB}$–$DV_2$) results in emission current 49 being equal to $I_2$.

The changes in the offset voltage of gate voltage 48 can be implemented by providing a variable voltage source for first voltage source 33. The timing of the changes in the voltage output of this variable voltage source is synchronized with the timing of first and second line time segments 53, 54. Gate voltage 48 can alternatively be controlled by manipulating the switching voltage, in a manner similar to the manipulation of the offset voltage as described with reference to FIG. 9.

Figure 10:
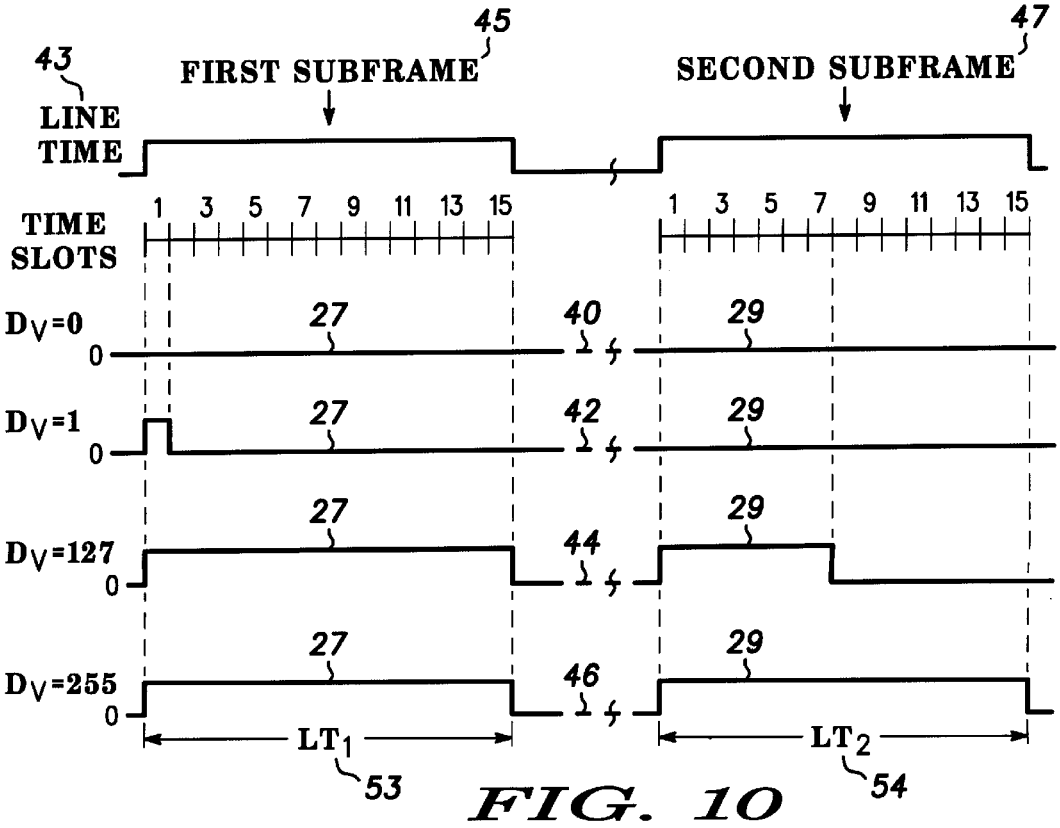
FIG. 10 is a timing diagram in accordance with another embodiment of the method of the invention.

FIG. 10 is a timing diagram of another example useful for implementing the method of the invention. In the embodiment of FIG. 10, each display frame is divided into N sub-frames. That is, the scanning rate is made equal to N times the input refresh rate. The line time of each sub-frame is equal to 1/N times the total line time of the frame. During each sub-frame, a number of digital sub-words, which is less than the entirety of the digital sub-words of the digital video word, is displayed. In the example of FIG. 10, only one digital sub-word of the digital video word is displayed per sub-frame. Implementation of the embodiment of FIG. 10 entails the use of a frame buffer, which is used to store digital sub-words, which are to be displayed after the first sub-frame.

As illustrated in FIG. 10, first and second line time segments 53, 54, occur during first and second sub-frames 45, 47, respectively. FIG. 10 includes configurations of first and second control signals 27, 29 ($S_1$ and $S_2$) for various decimal values, $D_v$, of digital video word 14, which are the same as those described with reference to FIG. 4.

The first plot of FIG. 10 illustrates the condition of first control signal 27 during first sub-frame 45 and the condition of second control signal 29 during second sub-frame 47 when digital video word 14 has a decimal value of zero. For this condition, first digital sub-word 16 has a decimal value, $D_L$, equal to zero, and second digital sub-word 17 has a decimal value, $D_M$, equal to zero. Consequently, when gate extraction electrode 36 is scanned during first sub-frame 45, first control signal 27 is inactive; when gate extraction electrode 36 is scanned during second sub-frame 47, second control signal 29 is also inactive. A dashed line 40 in FIG. 10 indicates that other control signals are used to drive cathode 35 during the scanning of the other gate extraction electrodes of FED 10. These other control signals are generated during the time (not shown; the omission is indicated by a curved vertical line in FIG. 10) between the illustrated consecutive scans of gate extraction electrode 36.

The second plot of FIG. 10 illustrates the condition of first control signal 27 during first sub-frame 45 and the condition of second control signal 29 during second sub-frame 47 when digital video word 14 has a decimal value of one. For this condition, first digital sub-word 16 has a decimal value, $D_L$, equal to one, and second digital sub-word 17 has a decimal value, $D_M$, equal to zero. Consequently, first control signal 27 becomes active during time slot one and is inactive for all other time slots within first line time segment 53 during first sub-frame 45. A dashed line 42 in FIG. 10 indicates that other control signals are used to drive cathode 35 during the scanning of the other gate extraction electrodes of FED 10. These other control signals are generated during the time (not shown; the omission is indicated by a curved vertical line in FIG. 10) between the illustrated consecutive scans of gate extraction electro de 36. Then, second control signal 29 is inactive for all time slots of second line time segment 54 during second sub-frame 47.

The third plot of FIG. 10 illustrates the condition of first control signal 27 during first sub-frame 45 and the condition of second control signal 29 during second sub-frame 47 when digital video word 14 has a decimal value of one-hundred twenty-seven. For this condition, first digital sub-word 16 has a decimal value, $D_L$, equal to fifteen, and second digital sub-word 17 has a decimal value, $D_M$, equal to seven. Consequently, first control signal 27 is active during time slots one through fifteen of first line time segment 53 during first sub-frame 45. Thereafter, as indicated by a dashed line 44 in FIG. 10, other control signals are used to drive cathode 35 during the scanning of the other gate extraction electrodes of FED 10 (not shown; omission indicated by a curved vertical line). When gate extraction electrode 36 is again scanned during second sub-frame 47, second control signal 29 is active during time slots one through seven of second line time segment 54.

The fourth plot of FIG. 10 illustrates the condition of first control signal 27 during first sub-frame 45 a nd the condition of second control signal 29 during second sub-frame 47 when digital video word 14 has a maximum decimal value of two-hundred fifty-five. For this condition, first digital sub-word 16 has a decimal value of fifteen, and second digital sub-word 17 has a decimal value of fifteen. Consequently, first control signal 27 is active during time slots one through fifteen of first line time segment 53 during first sub-frame 45. Thereafter, as indicated by a dashed line 46 in FIG. 10, other control signals are used to drive cathode 35 during the scanning of the other gate extraction electrodes of FED 10 (not shown; omission indicated by a curved vertical line). When gate extraction electrode 36 is again scanned during second sub-frame 47, second control signal 29 is active during time slots one through fifteen of second line time segment 54 during second sub-frame 47. In the embodiment of FIG. 10, the emission current during first sub-frame 45 is equal to $I_1$, and the emission current during second sub-frame 47 is equal to $I_2$.

The method of the invention is also useful with drive signal configurations other those depicted in the FIGURES. For example, the method of the invention can be used with a display control method described in a U.S. patent application entitled "Display Control Method", application Ser. No. 08/415,971, filed on Apr. 3, 1995, assigned to the same assignee, and which is hereby incorporated by reference. "Display Control Method" describes a method for driving a display, which reduces the number of transitions made by the column drivers. The method of the present invention can include the method of "Display Control Method" to reduce the number of transitions in the drive signals and reduce the power consumption of the display.

For example, when the first control signal is to be made active during a number of time slots equal to x, where x is less than fifteen, the first control signal is made active during the final x time slots of the first line time segment, rather than the first x time slots of the first line time segment. For example, when the first control signal is to be active over one time slot, it is made active over time slot fifteen. In this manner, for all active decimal values of the first digital sub-word, the final time slot during which the first control signal is made active is time slot fifteen of the first line time segment. Then, when the second control signal is also to be made active, the first time slot over which the second control signal is made active is time slot one of the second line time segment. In this manner, the active signal configuration is maintained at the transition between the first and second line time segments. Consequently, an active first drive signal is not switched to the off state prior to providing an active second drive signal. If the second control signal is to be made active during a number of time slots equal to y, where y is less than fifteen, the second control signal is made active during the first y time slots of the second line time segment.

In summary, the method of the invention includes the steps of dividing a digital video word into a plurality of digital sub-words, sequentially converting each of the plurality of digital sub-words into a control signal, and sequentially utilizing each control signal to control a drive signal. In contrast to the prior art, the method of the invention allows the use of smaller, lower cost drivers in flat panel displays that utilize pulse width modulation drive techniques.

While we have shown and described specific embodiments of the present invention, further modifications and improvements will occur to those skilled in the art. We desire it to be understood, therefore, that this invention is not limited to the particular forms shown, and we intend in the appended claims to cover all modifications that do not depart from the spirit and scope of this invention.

What is claimed is:

1. A method for driving a flat panel display comprising the steps of:

receiving a digital video word;

dividing the digital video word into a plurality of digital sub-words;

converting a first one of the plurality of digital sub-words into a first control signal;

utilizing the first control signal to control a first drive signal applied to the flat panel display;

thereafter, converting a second one of the plurality of digital sub-words into a second control signal; and utilizing the second control signal to control a second drive signal applied to the flat panel display, wherein an active time of the first and second control signals is determined by a value of, respectively, the first and second one of the plurality of digital sub-words.

2. The method for driving a flat panel display as claimed in claim 1, wherein a value of the first drive signal is responsive to the first control signal, and wherein a value of the second drive signal is responsive to the second control signal.

3. A method for driving a flat panel display comprising the steps of:

receiving a digital video word, wherein the digital video word has a plurality of digital sub-words;

selecting a first one of the plurality of digital sub-words;

converting the first one of the plurality of digital sub-words into a first control signal;

utilizing the first control signal to control a first drive signal applied to the flat panel display;

thereafter, selecting a second one of the plurality of digital sub-words;

converting the second one of the plurality of digital sub-words into a second control signal; and utilizing the second control signal to control a second drive signal applied to the flat panel display, wherein an active time of the first and second control signals is determined by a value of, respectively, the first and second one of the plurality of digital sub-words.

4. A method for driving a flat panel display comprising the steps of:

receiving a digital video word;

dividing the digital video word into a plurality of digital sub-words;

sequentially converting each of the plurality of digital sub-words into a control signal to define a plurality of control signals; and sequentially utilizing each of the plurality of control signals to control a drive signal applied to the flat panel display wherein an active time of each of the plurality of control signals is determined by a value of its respective digital sub-word.

5. The method for driving a flat panel display as claimed in claim 4, further including the step of providing a line time, and wherein the step of sequentially utilizing each of the plurality of control signals to control a drive signal, comprises the step of sequentially utilizing each of the plurality of control signals to control a drive signal during the line time.

6. The method for driving a flat panel display as claimed in claim 4, further including the step of providing a plurality of sub-frames, and wherein the step of sequentially utilizing each of the plurality of control signals to control a drive signal comprises the step of utilizing the plurality of control signals one each in the plurality of sub-frames.

7. The method for driving a flat panel display as claimed in claim 4, wherein the step of sequentially utilizing each of the plurality of control signals to control a drive signal comprises the step of sequentially applying each of the plurality of control signals to a voltage source to control an active time of an output voltage value.

8. The method for driving a flat panel display as claimed in claim 4, wherein the step of sequentially utilizing each of the plurality of control signals to control a drive signal includes the step of sequentially applying each of the plurality of control signals to a current source responsive to each of the plurality of control signals, wherein an output of the current source defines the drive signal.

9. The method for driving a flat panel display as claimed in claim 4, wherein the step of dividing the digital video word into a plurality of digital sub-words comprises the step of dividing an 8-bit video word into a first nibble and a second nibble.

10. A method for driving a flat panel display comprising the steps of:

providing an 8-bit video word, wherein the 8-bit video word has a least significant nibble and a most significant nibble;

selecting the least significant nibble converting the least significant nibble into a first control signal, wherein the first control signal has an active time responsive to a value of the least significant nibble;

utilizing the first control signal to control a first drive signal applied to the flat panel display, wherein an active time of the first drive signal is responsive to the first control signal;

thereafter, converting the most significant nibble into a second control signal, wherein the second control signal has an active time responsive to a value of the most significant nibble; and utilizing the second control signal to control a second drive signal applied to the flat panel display, wherein an active time of the second drive signal is responsive to the second control signal.

11. The method for driving a flat panel display as claimed in claim 10, wherein a value of the first drive signal is responsive to the first control signal, and wherein a value of the second drive signal is responsive to the second control signal.

12. A method for driving a flat panel display comprising the steps of:

providing an 8-bit video word, wherein the 8-bit video word has a least significant nibble and a most significant nibble;

selecting the most significant nibble;

converting the most significant nibble into a first control signal, wherein the first control signal has an active time responsive to a value of the most significant nibble;

utilizing the first control signal to control a first drive signal applied to the flat panel display, wherein an active time of the first drive signal is responsive to the first control signal;

thereafter, converting the least significant nibble into a second control signal, wherein the second control signal has an active time responsive to a value of the least significant nibble; and utilizing the second control signal to control a second drive signal applied to the flat panel display, wherein an active time of the second drive signal is responsive to the second control signal.

13. A method for driving a field emission display comprising the steps of:

providing an 8-bit video word, wherein the 8-bit video word has a least significant nibble and a most significant nibble;

selecting the least significant nibble;

converting the least significant nibble into a first control signal, wherein the first control signal has an active time responsive to a value of the least significant nibble;

utilizing the first control signal to control a first drive signal applied to the field emission display, wherein an active time of the first drive signal is responsive to the first control signal;

thereafter, converting the most significant nibble into a second control signal, wherein the second control signal has an active time responsive to a value of the most significant nibble; and utilizing the second control signal to control a second drive signal applied to the field emission display, wherein an active time of the second drive signal is responsive to the second control signal.

14. The method for driving a field emission display as claimed in claim 13, wherein a value of the first drive signal is responsive to the first control signal, and wherein a value of the second drive signal is responsive to the second control signal.

15. The method for driving a field emission display as claimed in claim 13, further comprising the steps of providing a gate voltage; providing, concurrent with the step of utilizing the first control signal to control a first drive signal, a first value of the gate voltage to define a first emission current; and providing, concurrent with the step of utilizing the second control signal to control a second drive signal, a second value of the gate voltage to define a second emission current.

16. The method for driving a field emission display as claimed in claim 15, wherein the gate voltage is defined by an offset voltage and a switching voltage, and wherein the step of providing a first value of the gate voltage comprises the step of providing a first value of the offset voltage, and wherein the step of providing a second value of the gate voltage comprises the step of providing a second value of the offset voltage.

17. The method for driving a field emission display as claimed in claim 15, wherein the gate voltage is defined by an offset voltage and a switching voltage, and wherein the step of providing a first value of the gate voltage comprises the step of providing a first value of the switching voltage, and wherein the step of providing a second value of the gate voltage comprises the step of providing a second value of the switching voltage.

* * * * *